US008035672B2

(12) United States Patent
Matsuda

(10) Patent No.: US 8,035,672 B2
(45) Date of Patent: Oct. 11, 2011

(54) PRINTING APPARATUS

(75) Inventor: Okiharu Matsuda, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 258 days.

(21) Appl. No.: 12/479,019

(22) Filed: Jun. 5, 2009

(65) Prior Publication Data

US 2009/0309945 A1 Dec. 17, 2009

(30) Foreign Application Priority Data

Jun. 12, 2008 (JP) ..... 2008-154294
Jun. 13, 2008 (JP) ..... 2008-155574
Jun. 13, 2008 (JP) ..... 2008-155575

(51) Int. Cl.
*B41J 2/36* (2006.01)

(52) U.S. Cl. ..... 347/188; 347/190
(58) Field of Classification Search ..... 347/188, 347/190; 400/120.09, 120.1
See application file for complete search history.

(56) References Cited

U.S. PATENT DOCUMENTS 4,679,053 A 7/1987 Katsurai et al.
4,843,409 A 6/1989 Matsuzaki
6,236,752 B1 * 5/2001 Katayama et al. ..... 382/183
2009/0309948 A1 12/2009 Matsuda et al.
2009/0309950 A1 12/2009 Matsuda

FOREIGN PATENT DOCUMENTS

EP 0 647 529 A2 4/1995
EP 0 811 500 A2 12/1997
EP 2133208 * 12/2009
JP 61-266269 11/1986
JP 07-25073 * 1/1995
JP 2005219382 8/2005
JP 2007030263 2/2007

OTHER PUBLICATIONS

European Search Report for 09007359.4 mailed on Sep. 30, 2009.

* cited by examiner

*Primary Examiner* — Huan Tran
(74) *Attorney, Agent, or Firm* — Turocy & Watson, LLP

(57) ABSTRACT

A printing apparatus includes a thermal head in which a plurality of heating elements are provided in a width direction of paper, an analyzing unit which analyzes whether an input print layout contains any bar code, a calculating unit which calculates a print ratio of a bar code portion in the paper for each line of the print layout in the case where the analyzing unit analyzes that at least the print layout contains a bar code, a setting unit which sets a printing velocity corresponding to the print ratio for one line in the bar code portion calculated by the calculating unit in the case where the analyzing unit analyzes that the print layout contains the bar code and a changing unit which changes a velocity at which the thermal head performs printing on the paper for one line to the printing velocity set by the setting unit.

3 Claims, 15 Drawing Sheets

14A

| Print ratio | Division number |
|---|---|
| 61~100% | Six parts |
| 31~60% | Three parts |
| 21~30% | Two parts |
| 0~20% | Not divided |

PRINTING APPARATUS

CROSS-REFERENCE TO RELATED APPLICATION

This application is based upon and claims the benefit of priority from prior Japanese Patent Applications No. 2008-154294, filed Jun. 12, 2008; No. 2008-155574, filed Jun. 13, 2008; and No. 2008-155575, filed Jun. 13, 2008, the entire contents of all of which are incorporated herein by reference.

TECHNICAL FIELD

The present invention relates to a printing apparatus equipped with a thermal head.

BACKGROUND

Conventional printing apparatuses (portable printers) include, for example, a thermal printer equipped with a thermal head which has a plurality of heating elements arranged in the width direction of paper to be printed on. For example, the portable thermal printer is generally driven by electric power of a battery. The thermal printer carries paper which is thermal paper a given distance every time a pulse motor operates one step. When printing is performed, the thermal printer heats heating elements corresponding to printing parts among a plurality of heating elements to enable printing of various kinds of information line by line.

Jpn. Pat. Appln. KOKAI Publication No. 2005-219382 describes the configuration of an apparatus capable of correcting printing misalignment without complication of control, wherein a printing position is corrected on the basis of print data stored in a storage unit so that characters can be printed at a proper printing position.

The configuration in Jpn. Pat. Appln. KOKAI Publication No. 2005-219382 does not describe any solution to printing misalignment in a thermal printer which varies the printing velocity in accordance with a print ratio. The print ratio is the ratio of heating elements that perform printing on paper among a plurality of heating elements provided in a thermal head. Especially when a bar code is contained in a print layout targeted for printing, a trouble may be caused in reading the bar code by a bar code reader if the bar code is printed on the paper in a misaligned state.

Jpn. Pat. Appln. KOKAI Publication No. 2007-30263 presents a portable printer, wherein heating elements in a thermal head are divided into a plurality of strobe blocks, and a strobe signal can be time-divisionally applied to each block so that each block is conducted at a separate time.

In general, when a line type thermal head is used to perform printing with a high print ratio for one line, a high current needs to be supplied in order to simultaneously apply strobe signals to a plurality of heating elements. However, in the case of, for example, the portable printer described above, the problem is that a high current is not obtained and an applied voltage is therefore decreased, leading to unclear printing or occurrence of a reset operation.

The portable printer described in Jpn. Pat. Appln. KOKAI Publication No. 2007-30263 sequentially applies the strobe signals to the respective strobe blocks to print on the paper being carried. Therefore, for example, when the plurality of heating elements in the thermal head are divided into six blocks and printing is performed, misalignment is caused between printing in the block to which the first strobe signal is applied and printing in the blocks to which the subsequent strobe signals are applied. This may disadvantageously lead to missing printing or varied printing thickness.

In particular, when the number of divided strobe blocks is changed, the degree of printing misalignment caused among the blocks before the change of the number of divided strobe blocks is different from that caused after the change. This may disadvantageously lead to missing printing or greatly varied printing thickness.

Furthermore, in the portable printer described in Jpn. Pat. Appln. KOKAI Publication No. 2007-30263, the conducting time of the thermal head and the velocity of carrying paper by a pulse motor are determined on the basis of the print ratio of print data.

In the case of the pulse motor used in such a portable printer, the carrying velocity of paper greatly changes if, for example, the print ratio greatly changes from line to line. However, as a platen roller for transmitting the operation of the pulse motor to the paper has a moment of inertia, there is actually a limit value in the velocity (acceleration or deceleration) that can be changed in one step. When a velocity change that exceeds this limit value is required, it may no be possible to carry the paper at a target carrying velocity. As a result, it is not possible to print at an intended position, which disadvantageously leads to missing printing or extended printing.

In order to avoid such a situation, printing may be performed so that the paper is carried without exceeding the minimum velocity. In this case, however, the problem is that processing takes much time.

It is an object of the present invention to provide a printing apparatus capable of correct printing with no decrease in printing velocity.

SUMMARY

According to one aspect of the present invention, there is provided a printing apparatus comprising: a thermal head in which a plurality of heating elements are provided in a width direction of paper, an analyzing unit which analyzes whether an input print layout contains any bar code, a calculating unit which calculates a print ratio of a bar code portion in the paper for each line of the print layout in the case where the analyzing unit analyzes that at least the print layout contains a bar code, a setting unit which sets a printing velocity corresponding to the print ratio for one line in the bar code portion calculated by the calculating unit in the case where the analyzing unit analyzes that the print layout contains the bar code and a changing unit which changes a velocity at which the thermal head performs printing on the paper for one line to the printing velocity set by the setting unit.

DETAILED DESCRIPTION

Embodiments are described below with reference to the drawings.

Figure 1:
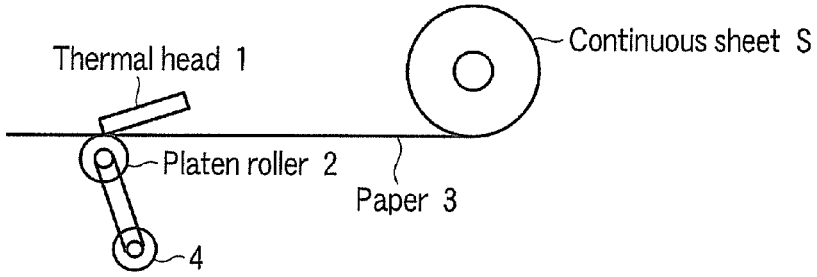
FIG. 1 is a diagram showing a schematic configuration of a thermal printer of a first embodiment.

FIG. 1 is a diagram showing a schematic configuration of a thermal printer (portable printer) 10 according to a first embodiment. The thermal printer 10 comprises a thermal head 1 and a platen roller 2. The thermal head 1 and the platen roller 2 are arranged to hold, in between, paper 3 supplied from a wound continuous sheet S (e.g., receipt paper).

The thermal head 1 is urged by an unshown urging member so that one end is rotatably supported and the other end is pressed into contact with the platen roller 2. Therefore, the thermal head 1 is replaceable. The platen roller 2 is coupled to a pulse motor 4 via a belt, and is rotated by the rotation of the pulse motor 4.

The paper 3 is carried between the thermal head 1 and the platen roller 2 by the rotation of the platen roller 2. The thermal head 1 has a plurality of heating elements arranged in the width direction of the continuous sheet S. The thermal head 1 heats proper ones of these heating elements to enable printing on the paper 3 which is thermal paper. The thermal head 1 sequentially performs printing for each line which is applied as print data. In addition, the rotating distance of the platen roller 2, that is to say, the carrying distance of the paper 3 for a one-pulse operation of the pulse motor is determined by, for example, the gear ratio of the above-mentioned mechanism.

Figure 2:
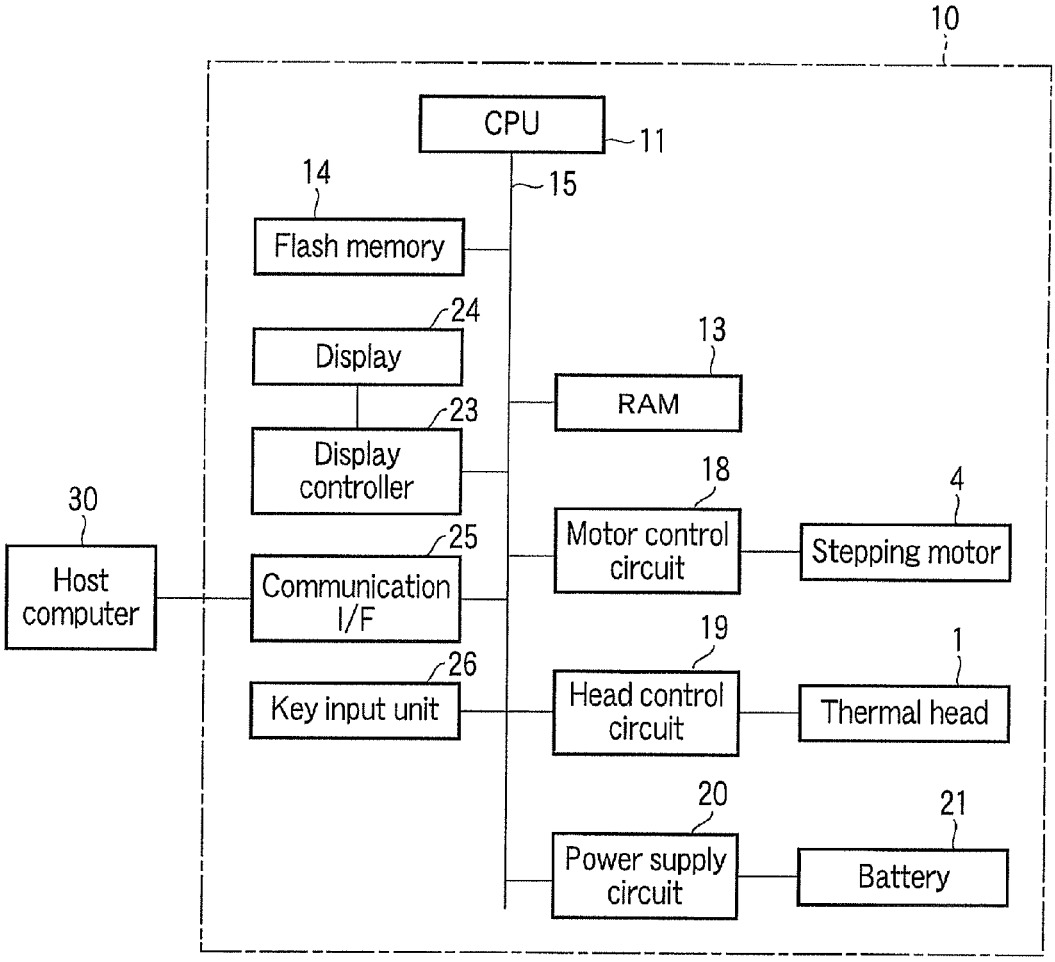
FIG. 2 is a block diagram showing the configuration of the thermal printer of the first embodiment.

FIG. 2 is a block diagram showing the configuration of the thermal printer 10 of the first embodiment. The thermal printer 10 comprises a CPU 11 which executes various kinds of arithmetic processing and which controls various units in a concentrated manner. A RAM 13 and a memory including a flash memory 14 are connected to the CPU 11 via a system bus 15.

Figure 3:
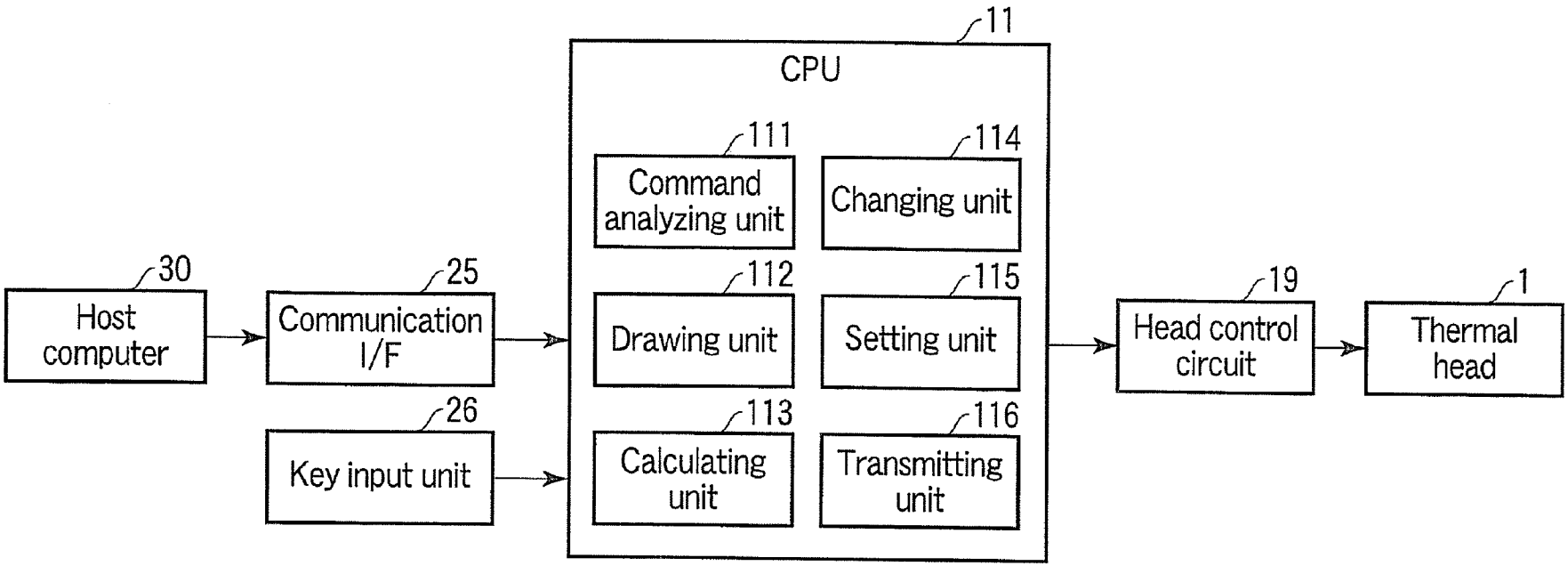
FIG. 3 is a block diagram showing in detail a control unit of the thermal printer of the first embodiment.

FIG. 3 is a block diagram showing the CPU 11 of the first embodiment in concrete form. The CPU 11 includes a command analyzing unit 111, a drawing unit 112, a calculating unit 113, a changing unit 114, a setting unit 115 and a transmitting unit 116. The command analyzing unit 111 analyzes whether a printing target print layout input or selected by a key input unit 26 or a host computer is composed of bar codes or characters in accordance with a command contained in input print layout information. That is to say, the command analyzing unit 111 functions as an analyzing unit for analyzing commands. The drawing unit 112 develops the print layout information after the command analysis as print data. The calculating unit 113 calculates a print ratio for one line of the print layout. The print ratio is the ratio of the heating elements which perform printing on the paper 3 under the control of a print data signal for one line among the plurality of heating elements arranged in the thermal head 1. That is to say, the print ratio is the ratio of printing parts (dark parts) in a one-line part (blank part) of the paper 3. The changing unit 114 switches the thermal head 1 so that the thermal head 1 performs printing at a printing velocity preset in accordance with the print ratio. When the print layout contains bar codes, the setting unit 115 sets a printing velocity corresponding to a print ratio equal to or higher than a predetermined value if the value of the print ratio of a bar code part for one line is lower than a predetermined value. The changing of the printing velocity in the case where the print layout contains bar codes will be described later. The transmitting unit 116 transmits the print data signal for one line and printing velocity information to the heating elements provided in the thermal head 1.

The flash memory 14 stores an operation program for the thermal printer 10. The CPU 11 copies the operation program stored in the flash memory 14 into the RAM 13 and executes the operation program to control the various units. The operation program includes, for example, a program to perform printing processing. The RAM 13 temporarily stores various kinds of variable information. The RAM 13 also temporarily stores the print layout information input by the host computer. Part of the area in the RAM 13 is used as a printing buffer for the print data in the print layout which has been developed by the drawing unit 112 and which is to be printed on the paper 3. The flash memory 14 also stores printing target print data received from a host computer 30.

A motor control circuit 18, a head control circuit 19 and a power supply circuit 20 are also connected to the CPU 11.

The motor control circuit 18 rotationally drives the pulse motor 4 under the control of the CPU 11. The motor control circuit 18 controls the velocity of the operation of the pulse motor 4 in accordance with the print ratio of the print data. The head control circuit 19 controls the printing on the paper 3 by the thermal head 1 under the control of the CPU 11. The power supply circuit 20 supplies the various units with electric power accumulated in a battery 21, and controls the charging of the battery 21.

A display controller 23, a communication interface 25 and a key input unit 26 are also connected to the CPU 11.

The display controller 23 controls the display operation in a display 24 under the control of the CPU 11. The display 24 displays various kinds of information such as a printing status. The communication interface (I/F) 25 is an interface for connection to an external device such as the host computer 30 (host device). The host computer 30 includes various kinds of information equipment having a function to execute data processing in accordance with an input from a user, such as a personal computer (PC), a mobile telephone and a handy terminal. The communication interface 25 is a communication interface provided in the host computer, for example, an infrared communication such as IrDA, a universal serial bus (USB), a local area network (LAN), RS-232C or bluetooth (registered trademark). The key input unit 26 includes input keys by which the user instructs the thermal printer 10.

The changing of the printing velocity of the thermal head 1 in accordance with a print ratio is described below in connection with the case in the first embodiment where the print layout contains bar codes.

Figure 4:
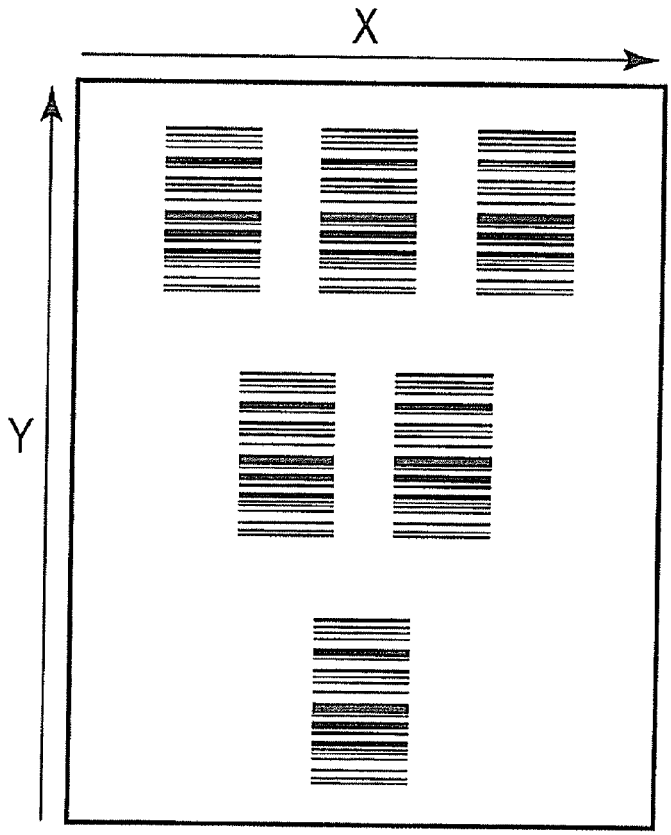
FIG. 4 is a diagram showing a print layout printed by the thermal printer of the first embodiment.

FIG. 4 is a diagram showing a developed print layout which is a printing target. The user selects or inputs the print layout by use of the key input unit 26 or the host computer 30 which is an external device. When the print layout is selected by the host computer 30, print layout information received via the communication I/F 25 is temporarily stored in the RAM 13. When the print layout is selected by the key input unit 26, the CPU 11 reads print layout information stored in, for example, the flash memory 14 in accordance with an input command.

Here, the print layout shown in FIG. 4 is composed of six bar codes. The X-direction of the print layout corresponds to the width direction of the paper 3, that is to say, the arrangement direction of the heating elements provided in the thermal head 1. The Y-direction of the print layout corresponds to the longitudinal direction of the paper 3, that is to say, the direction in which the paper 3 is carried by the platen roller 2. Each of the bar codes composing the print layout includes a plurality of bars parallel with the X-direction which is the width direction of the paper 3. The transmitting unit 116 sequentially transmits a print data signal for one line in the X-direction of the print layout to the thermal head 1.

Furthermore, the thermal head 1 heats the proper heating elements on the basis of the received print data information for one line to print on the paper 3 which is thermal paper. In addition, the print layout is composed of three stages of equally shaped bar codes along the Y-direction. A part where the bar codes are arranged in three lines is defined as an upper stage. A part where the bar codes are arranged in two lines is defined as a middle stage. A part where the bar code is arranged in one line is defined as a lower stage.

The command analyzing unit 111 analyzes the print layout information stored in the RAM 13 or the flash memory 14 to find how the bar codes or characters are arranged.

Then, the drawing unit 112 develops the print layout information after the command analysis as print data. Further, the RAM 13 records the print data on the developed print layout information. In this case, the CPU 11 can also display the print layout on the display 24.

Subsequently, the calculating unit 113 calculates a print ratio for each line of the print layout. When the print ratio for one line is calculated, the changing unit 114 switches the printing velocity so that the thermal head 1 performs printing at a printing velocity preset in accordance with the print ratio. The changing unit 114 sets a lower printing velocity for a higher print ratio. Therefore, when the print ratio is low for one line, the printing velocity is high, so that printing time for the whole print layout is shorter than when the velocity is constant, which makes it more convenient for the user.

The transmitting unit 116 transmits the print data signal for one line and information on the printing velocity corresponding to the print ratio to the heating elements provided in the thermal head 1.

Figure 5:
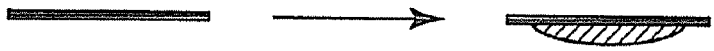
FIG. 5 is a diagram showing a tracing produced when printing is performed at a high velocity by the thermal printer of the first embodiment.

FIG. 5 is a diagram showing a portion of the bar code disposed at the lower stage of the print layout shown in FIG. 3. Since one line of bar code is only disposed at the lower stage of the print layout, the print ratio at the lower stage is lower than the print ratio for one line at the upper or middle stage. Thus, the printing velocity for one line at the lower stage is higher than the printing velocity for one line at the upper or middle stage. In this case, as shown in the right part of FIG. 5, tracing, that is to say, a blur phenomenon occurs in a printed part.

When the thermal head 1 performs printing at a printing velocity corresponding to the print ratio for one line at the upper stage where the bar codes are arranged in three lines and the middle stage where the bar codes are arranged in two lines, the tracing shown in FIG. 5 does not occur. On the other hand, when the thermal head 1 performs printing at a printing velocity corresponding to the print ratio for one line at the lower stage where the bar code is arranged in one line, the tracing occurs due to storage of heat.

As shown in FIG. 4, the bar code arranged in the print layout in the first embodiment is a bar code including a plurality of bars parallel with the X-direction which is the arrangement direction of the heating elements provided in the thermal head 1 (referred to as a serial bar code). Therefore, when tracing is caused in the bar code at the lower stage of the print layout printed on the paper 3, a bar code reader may cause a reading error in reading this bar code.

Figure 6:
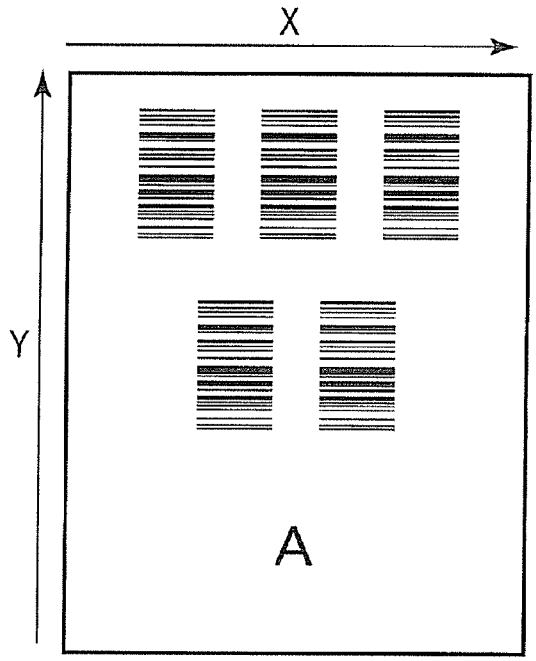
FIG. 6 is a diagram showing a print layout printed by the thermal printer of the first embodiment.

Here, FIG. 6 is a diagram showing another print layout set as a printing target. The print layout includes five bar codes and one character (A) arranged therein.

Each of the five bar codes composing the print layout includes a plurality of bars parallel with the X-direction which is the width direction of the paper 3. A part where the bar codes are arranged in three lines is defined as an upper stage. A part where the bar codes are arranged in two lines is defined as a middle stage. A part where one character is arranged is defined as a lower stage. The five bar codes composing the print layout are equally shaped serial bar codes.

As long as the printing velocity corresponds to the print ratio for one line at the upper stage where the serial bar codes are arranged in three lines and the middle stage where the serial bar codes are arranged in two lines, the tracing shown in FIG. 5 does not occur as in the case described above. On the other hand, the tracing occurs at the printing velocity corresponding to the print ratio for one line at the lower stage where the character is arranged in one line. In this case, there is no problem as long as the user can recognize the character even if the tracing is caused to the character printed on the paper 3.

Therefore, in the case of the printing of a bar code including a plurality of bars parallel with the Y-direction (referred to as a parallel bar code) or in the case of the printing of a flexible bar code and a character specified dot by dot, the occurrence of the tracing does not affect the reading of the bar codes printed on the paper 3 by the bar code reader or the recognition of the character by the user.

That is to say, in the first embodiment, printing should be performed at a printing velocity that does not cause tracing to the printed bar code when a serial bar code based on a world product code (WPC) is printed on the paper 3.

When the command analyzing unit 111 judges that the lower stage of the print layout contains a character as shown in FIG. 6, the changing unit 114 switches the printing velocity in accordance with the print ratio for one line in the character portion of the lower stage. Further, the transmitting unit 116 transmits a print data signal for one line and information on the printing velocity corresponding to the print ratio to the heating elements provided in the thermal head 1.

That is to say, the thermal head 1 performs printing at the printing velocity corresponding to the print ratio without reducing the printing velocity for the character portion of the lower stage of the print layout. Thus, in the case where the lower stage of the print layout includes the character portion as shown in FIG. 6, the printing velocity of the thermal head 1 is higher than in the case where the lower stage of the print layout includes the bar code portion as shown in FIG. 4.

When the command analyzing unit 111 judges that the lower stage of the print layout contains a bar code as shown in FIG. 4, the setting unit 115 judges whether the print ratio for one line in the bar code portion of the lower stage is lower than the value of a predetermined print ratio. When judging that the print ratio is lower than the value of the predetermined print ratio, the setting unit 115 sets a printing velocity corresponding to a print ratio equal to or higher than the predetermined value in the following manner.

That is to say, when the thermal head 1 prints, on the paper 3, the bar code portion of the lower stage of the print layout shown in FIG. 4, the printing velocity is always equal to or lower than the predetermined printing velocity, so that the tracing shown in FIG. 5 is not caused to the bar code printed on the paper 3.

Figure 7:
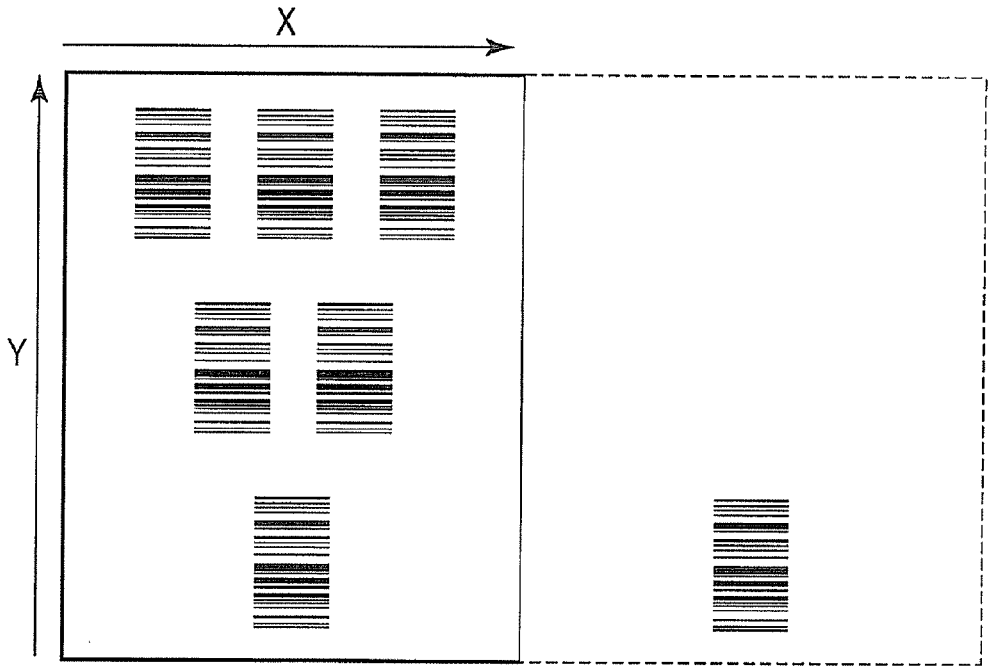
FIG. 7 is a diagram in which a virtual region is provided for the print layout printed by the thermal printer of the first embodiment.

FIG. 7 is a diagram showing how the setting unit 115 calculates a printing velocity corresponding to the print ratio equal to or higher than the predetermined value. The setting unit 115 creates not only a print layout but also a virtual region symmetrical to the print layout with respect to one end of the print layout in the X-direction, and then records the print layout and the virtual region in the RAM 13.

The setting unit 115 calculates a print ratio for one line in the bar code portions of the lower stages arranged in the print layout and the virtual region. As the same bar code is displayed in the virtual region in addition to the bar code provided at the lower stage of the print layout, the number of dots per line is equal to the value in which the number of dots in the bar code provided in the print layout is added to the number of dots in the bar code displayed in the virtual region. That is to say, the number of added dots is equal to double the number of dots for one line of the print layout. The number of heating elements arranged in the thermal head 1 is known. Thus, the setting unit 115 calculates a print ratio which is the ratio of the number of dots for one line to the number of heating elements arranged in the thermal head 1. Further, the setting unit 115 sets a printing velocity corresponding to the print ratio per line. That is to say, the setting unit 115 sets the same printing velocity as the printing velocity for one line in two lines of bar code portions arranged at the middle stage of the print layout.

Furthermore, the transmitting unit 116 transmits a print data signal for one line and information on the set printing velocity to the heating elements provided in the thermal head 1. As a result, the thermal head 1 can print the bar code at the lower stage of the print layout without causing tracing on the paper 3.

Figure 8:
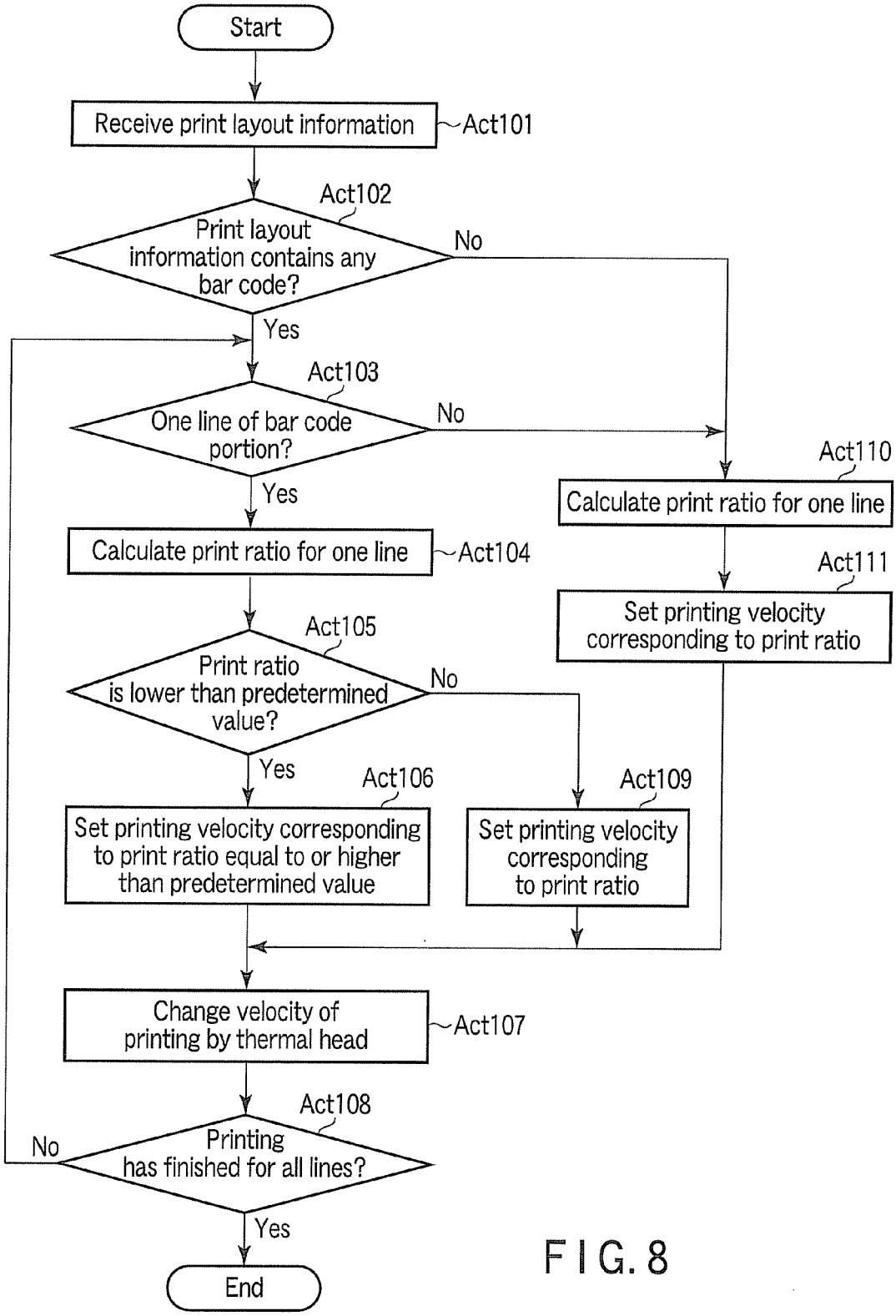
FIG. 8 is a flowchart showing a flow up to the setting of a velocity at which one line is printed by the thermal head of the first embodiment.

FIG. 8 is a flowchart showing a flow up to the setting of a velocity at which one line is printed by the thermal head 1 described above. First, the CPU 11 temporarily stores, in the RAM 13, print layout information received via the communication I/F 25 (Act101). The command analyzing unit 111 analyzes whether the print layout information contains any bar code (Act102).

When the print layout information contains bar codes (Act102, YES), the command analyzing unit 111 analyzes whether a portion for one line to be printed is a bar code portion (Act103). If the portion for one line to be printed is the bar code portion (Act103, YES), the calculating unit 113 calculates a print ratio for one line (Act104).

Furthermore, the setting unit 115 judges whether the print ratio is lower than a predetermined value (Act105). When the print ratio is lower than the predetermined value (Act105, YES), the setting unit 115 sets a printing velocity corresponding to the print ratio equal to or higher than the predetermined value (Act106). The changing unit 114 changes the printing velocity so that the thermal head 1 performs printing at a printing velocity preset by the setting unit 115 (Act107).

Then, the CPU 11 judges whether printing for all the lines has finished (Act108). When printing for all the lines has finished (Act108, YES), the CPU 11 finishes the printing of the print layout information. When printing for all the lines has not finished (Act108, NO), the command analyzing unit 111 performs processing in Act102.

When the setting unit 115 judges that the print ratio is equal to or higher than the predetermined value (Act105, NO), the setting unit 115 sets a printing velocity corresponding to the print ratio calculated by the calculating unit 113 (Act109). The flow in and after Act107 is similar to the flow described above.

When the print layout information contains no bar codes (Act102, NO) or when the print layout information contains bar codes but the portion for one line to be printed is not a bar code portion (Act103, NO), the calculating unit 113 calculates a print ratio for one line (Act110). The setting unit 115 sets a printing velocity corresponding to the print ratio calculated by the calculating unit 113 (Act111). The flow in and after Act107 is similar to the flow described above.

According to the first embodiment described above, the thermal head 1 can print a bar code on the paper 3 without causing tracing to the bar code even when the print layout contains the bar code. Consequently, the user does not have any trouble in reading a printed bar code by the bar code reader.

In the first embodiment described above, the CPU 11 creates the print layout and the virtual region as a printing target to change the printing velocity. Otherwise, when the user inputs a print layout by the key input unit 26 or the host computer, a flag may be set on a table in which the position and configuration of the print layout are associated with each other. Accordingly, the CPU 11 may perform flag control to decrease the printing velocity for the bar code portion having the configuration to which the flag is set.

In the first embodiment described above, the CPU 11 provided in the thermal printer 10 determines the printing velocity for the print layout received from the host computer 30 which is an external device. The host computer 30 which is the external device may have the function of the CPU 11 shown in FIG. 2 or 3, so that the host computer 30 may determine the printing velocity for one line of the print layout and transmit a print data signal and printing velocity information to the thermal printer 10. That is to say, the thermal printer 10 is configured inclusive of the host computer 30 which is the external device. In other words, the print ratio at which the thermal head 1 prints on the paper 3 may be determined by either the host computer 30 or the thermal printer 10.

Consequently, even when a bar code arranged in any form with respect to the carrying direction of the paper 3 is to be printed by the thermal head 1, the thermal printer 10 can switch to a printing velocity at which a bar code that causes no trouble in reading by the bar code reader is printed.

Now, a second embodiment is described. In the second embodiment, the heating elements provided in the thermal head 1 are divided into a plurality of blocks (hereinafter referred to as strobe blocks), and a strobe signal is applied on the strobe-block basis to heat the heating elements.

Figure 9:
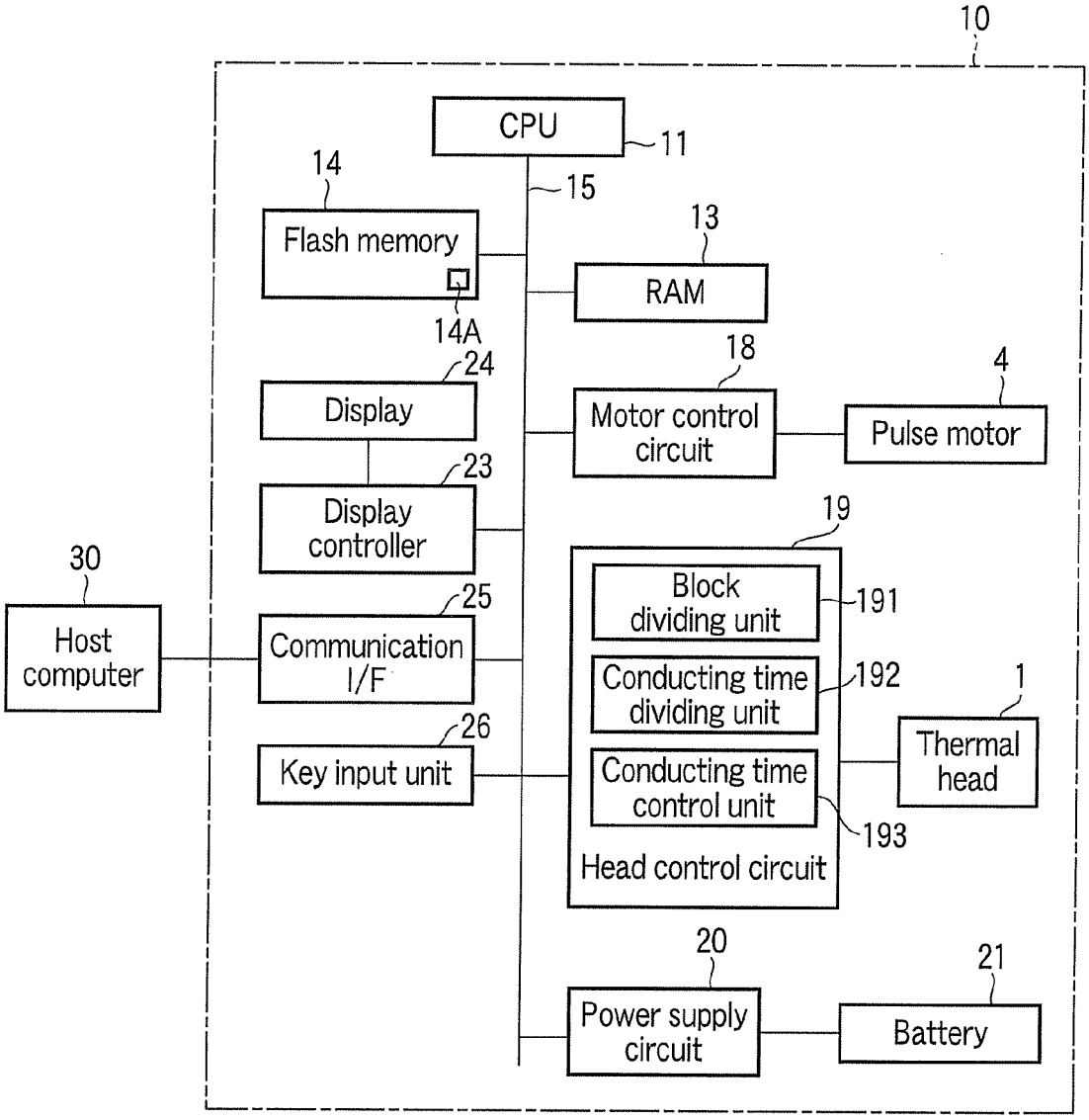
FIG. 9 is a block diagram showing the configuration of a thermal printer of a second embodiment.

FIG. 9 is a block diagram showing the configuration of a thermal printer 10 of a second embodiment. Parts with the same sings as the parts in the configuration of the thermal printer 10 of the first embodiment shown in FIG. 2 are not described.

As an operation program, a flash memory 14 includes, for example, a program for executing block dividing processing described later or printing processing. As data used for the operation program, the flash memory 14 also includes conducting time division information 14A used in conducting time dividing processing described later.

A head control circuit 19 applies a strobe signal to the heating elements provided in the thermal head 1, and controls the printing on paper 3. As shown in FIG. 9, the head control circuit 19 includes a block dividing unit 191, a conducting time dividing unit 192 and a conducting time control unit 193.

The block dividing unit 191 performs the block dividing processing for divining the heating elements provided in the thermal head 1 into a plurality of strobe blocks under the control of a CPU 11.

Figures 10, 11:
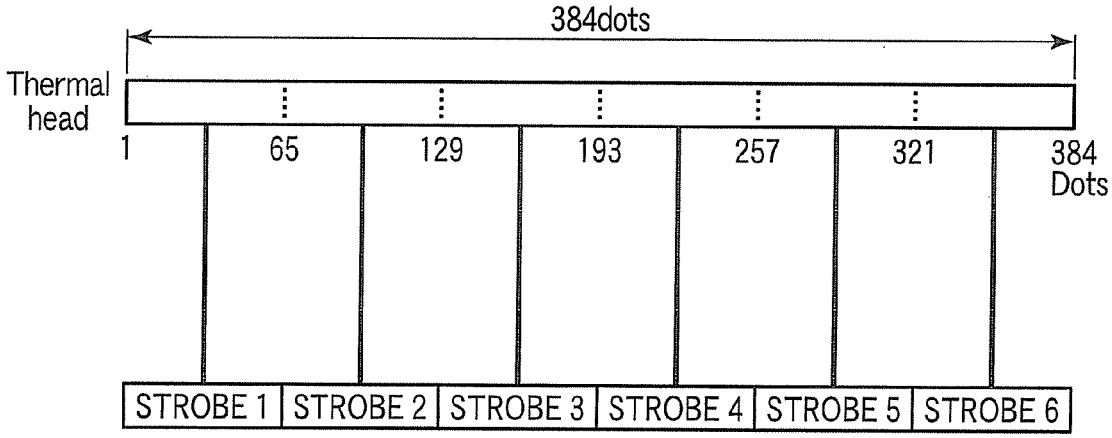
FIG. 10 is a diagram explaining strobe blocks of a thermal head of the second embodiment.
FIG. 11 is a graph explaining conducting time division information of the second embodiment.

FIG. 10 is an explanatory diagram for explaining the strobe blocks of the thermal head 1. As shown in FIG. 10, the thermal head 1 is provided with the heating elements for 384 dots in the width direction of the paper 3. The block dividing unit 191 can divide the heating elements for 384 dots in the thermal head 1 into a maximum of six strobe blocks each including the heating elements for 64 dots in accordance with the above-mentioned block dividing processing.

Moreover, the thermal head 1 can collectively apply the strobe signals (STROBEs 1 to 6) to the heating elements for 64 dots in each strobe block. Accordingly, the block dividing unit 191 time-divides the strobe blocks on a block basis so that each block is conducted at a separate time. In addition, the block dividing unit 191 performs the block dividing processing line by line on the basis of the print ratio of print data for one line.

The conducting time dividing unit 192 performs, line by line, the conducting time dividing processing for dividing, into a plurality of phases, the conducting time of the strobe signal for one line which has been divided into each block.

For example, when printing is performed in a plurality of strobe blocks divided by the block dividing processing, the head control circuit 19 calculates the conducting time of the strobe signal for each block. When the conducting time dividing processing is performed, the conducting time dividing unit 192 divides the calculated conducting time by the division number based on the print ratio of the print data for one line and based on the conducting time division information 14A shown in FIG. 11. That is to say, the conducting time dividing unit 192 further divides the strobe signal which has been divided into each block.

FIG. 11 is a graph for explaining the conducting time division information 14A. The flash memory 14 stores the conducting time division information 14A indicating the correlation between the print ratio of the print data for one line and the division number of the conducting time in the conducting time dividing processing. That is to say, the flash memory 14 functions as a conducting time division information storage unit.

As shown in FIG. 11, when the print ratio of the print data for one line is between 61% and 100%, the conducting time dividing unit 192 divides the conducting time into six parts. That is to say, the conducting time dividing unit 192 divides the strobe signal for one line into six phases.

When the print ratio of the print data for one line is between 31% and 60%, the conducting time dividing unit 192 divides the conducting time into three parts. That is to say, the conducting time dividing unit 192 divides the strobe signal for one line into three phases.

When the print ratio of the print data for one line is between 21% and 30%, the conducting time dividing unit 192 divides the conducting time into two parts. That is to say, the conducting time dividing unit 192 divides the strobe signal for one line into two phases.

When the print ratio of the print data for one line is between 0% and 20%, the conducting time dividing unit 192 does not divide the conducting time.

In addition, the conducting time division information 14A can be suitably changed in accordance with the information input by the key input unit 26 or input from the host computer 30.

The conducting time control unit 193 is a timer circuit for controlling the timing for the application of the strobe signal and the conducting time on a strobe-block basis. The conducting time control unit 193 sequentially applies, block by block, the strobe signal which has been divided into a plurality of blocks by the conducting time dividing processing.

For example, suppose that the thermal head 1 is divided into six strobe blocks and that the conducting time of the strobe signal in each block is divided into three parts. In this case, the conducting time control unit 193 sequentially applies one of the strobe signals divided into three parts in each block to the corresponding strobe block of the thermal head 1. At this point, the conducting time control unit 193 performs processing to apply the strobe signals in three phases wherein one phase corresponds to one of the strobe signals which are sequentially applied to the strobe blocks and which are assigned one by one to the respective blocks.

Figure 12:
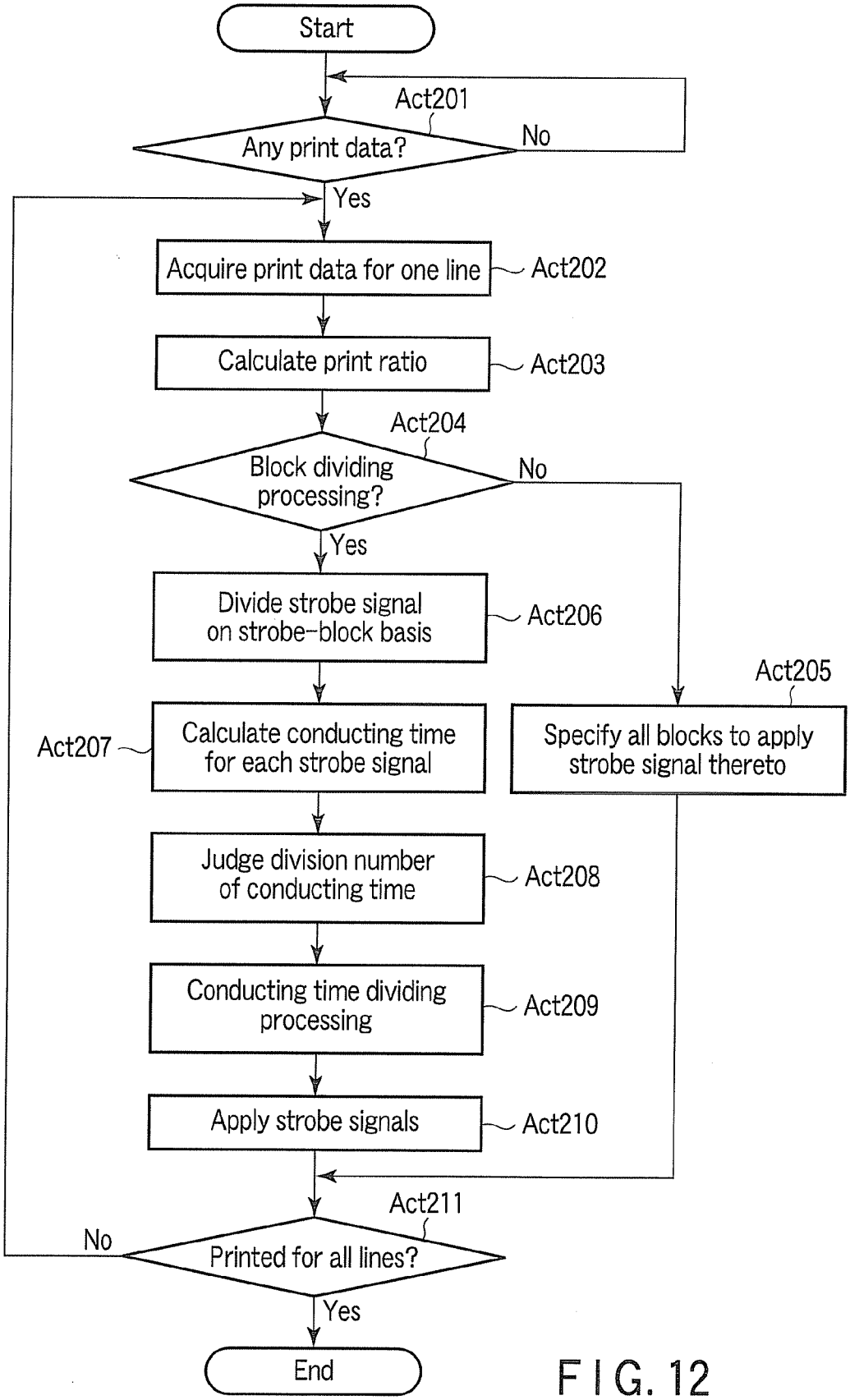
FIG. 12 is a flowchart explaining processing in the case of printing by the portable printer of the second embodiment.

FIG. 12 is a flowchart for explaining processing in the case of printing by the thermal printer 10 shown in FIG. 9.

When the thermal printer 10 is powered on, a system is started. That is to say, the CPU 11 reads various programs from the flash memory 14, and expands the programs in the RAM 13. When the system is started, the CPU 11 checks the system. That is to say, the CPU 11 examines the state of each unit in the thermal printer 10.

When started, the CPU 11 of the thermal printer 10 is ready to receive print data (Act201). On receipt of print data (Act201, YES), the CPU 11 acquires print data for one line (Act202). The CPU 11 calculates a print ratio of the print data for one line (Act203). That is to say, from information on the number of dark parts contained in the print data for one line, the CPU 11 calculates the ratio of the heating elements to which the strobe signals need to be applied among all of the heating elements provided in the thermal head 1.

On the basis of the calculated print ratio, the CPU 11 judges whether to perform the block dividing processing and also judges the number of strobe blocks to be divided (Act204).

When judging that the block dividing processing is not performed (Act204, NO), the CPU 11 applies the strobe signals for one line to all of the strobe blocks (Act205).

When the block dividing processing is performed (Act204, YES), the block dividing unit 191 divides the heating elements provided in the thermal head 1 into a plurality of strobe blocks and time-divides the strobe signal into each block under the control of the CPU 11 (Act206). The head control circuit 19 calculates the conducting time of the strobe signal for each of the divided blocks (Act207). Here, strobe signals as shown in FIG. 13 are generated.

Figure 13:
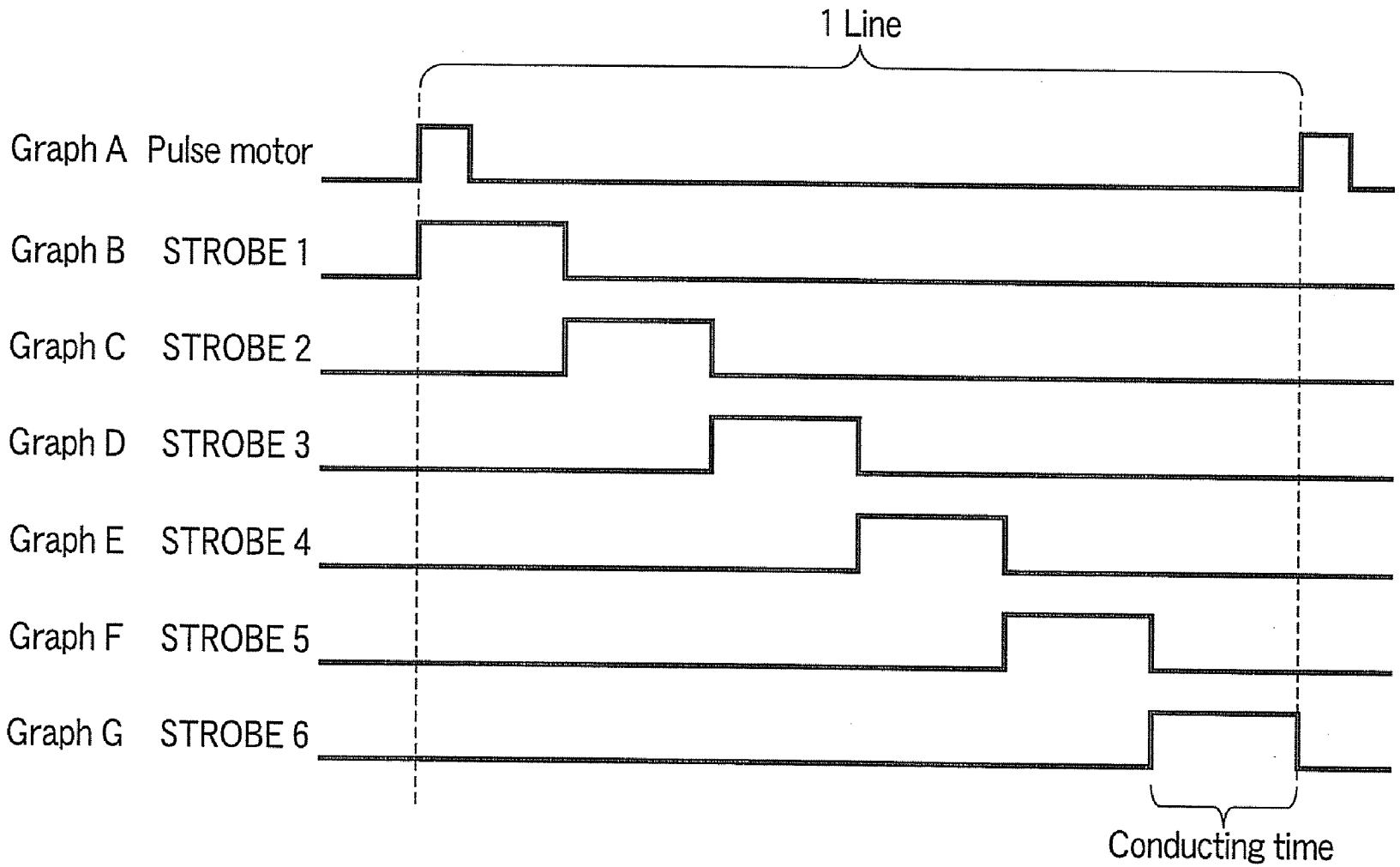
FIG. 13 is a timing chart showing the timing of the application of strobe signals to the respective blocks in the thermal head of the second embodiment.

FIG. 13 is a timing chart showing the timing of the application of the strobe signals (STROBEs 1 to 6) to the respective blocks in the thermal head 1.

A graph A in FIG. 13 shows an example of the period of a pulse motor 4, wherein the paper 3 is carried one dot (line) in one pulse. If this period is shorter, the printing velocity is higher. In order to perform printing for one line, the strobe signals have to be applied to all of the heating elements in the thermal head 1 within one pulse. For example, when the thermal head 1 is divided into six strobe blocks, the head control circuit 19 sequentially applies the strobe signals 1 to 6 to the respective strobe blocks in a time-divisional manner, as indicated in graphs B to G in FIG. 13. For example, when printing is performed using such strobe signals, the result is as shown in FIG. 14.

Figure 14:
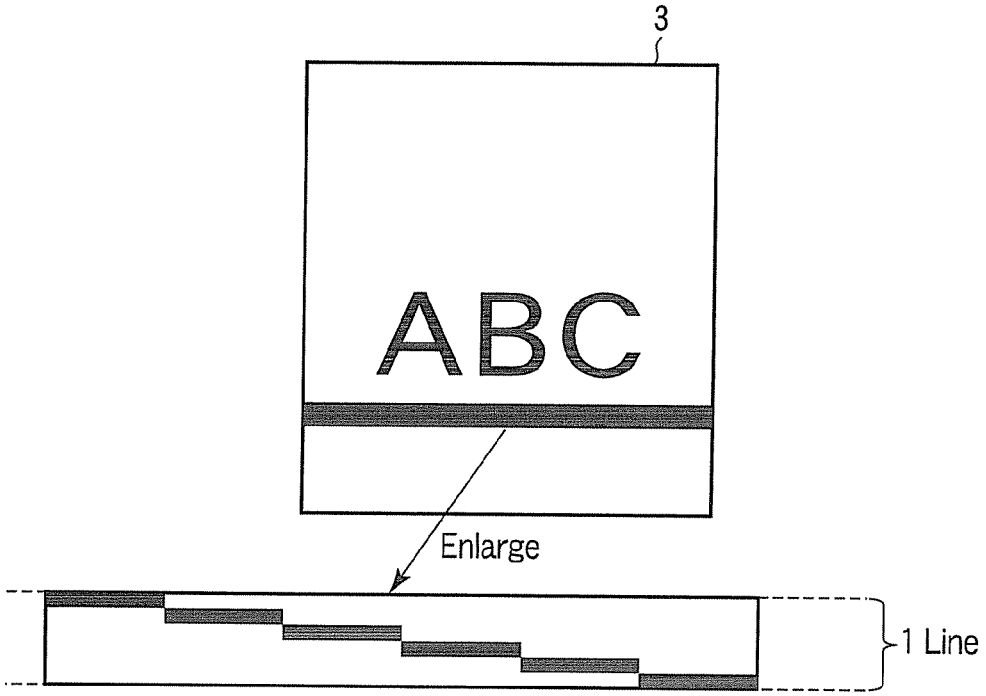
FIG. 14 is a diagram showing an example of printing in the case where the strobe block in the thermal head is divided into six parts of the second embodiment.

FIG. 14 is a diagram showing an example of printing in the case where the strobe block in the thermal head 1 is divided into six parts. As shown in FIG. 14, the divided strobe signals (STROBEs 1 to 6) are time-divisionally applied in a line with a high print ratio, so that considerable misalignment is caused between the printing in the block to which the first strobe signal is applied and the printing in the blocks to which the subsequent strobe signals are applied.

Furthermore, the CPU 11 decides the division number in the conducting time dividing processing on the basis of the print ratio calculated in Act203 shown in FIG. 12 and the conducting time division information shown in FIG. 11 (Act208). The CPU 11 reports the decided division number to the conducting time dividing unit 192 of the head control circuit 19.

The conducting time dividing unit 192 divides, into the decided number of divided phases, the conducting time of the strobe signal for one line which has been divided into each block (Act209). That is to say, the conducting time dividing unit 192 further divides the strobe signal which has been divided into each block.

The conducting time control unit 193 applies, phase by phase, the strobe signal which has been divided into each block by the conducting time dividing processing to each block in the thermal head 1 (Act210). Accordingly, the heating elements in the thermal head 1 are heated, and the heat is provided to the paper 3, thereby performing printing for one line. Here, strobe signals as shown in FIG. 15 are generated.

Figure 15:
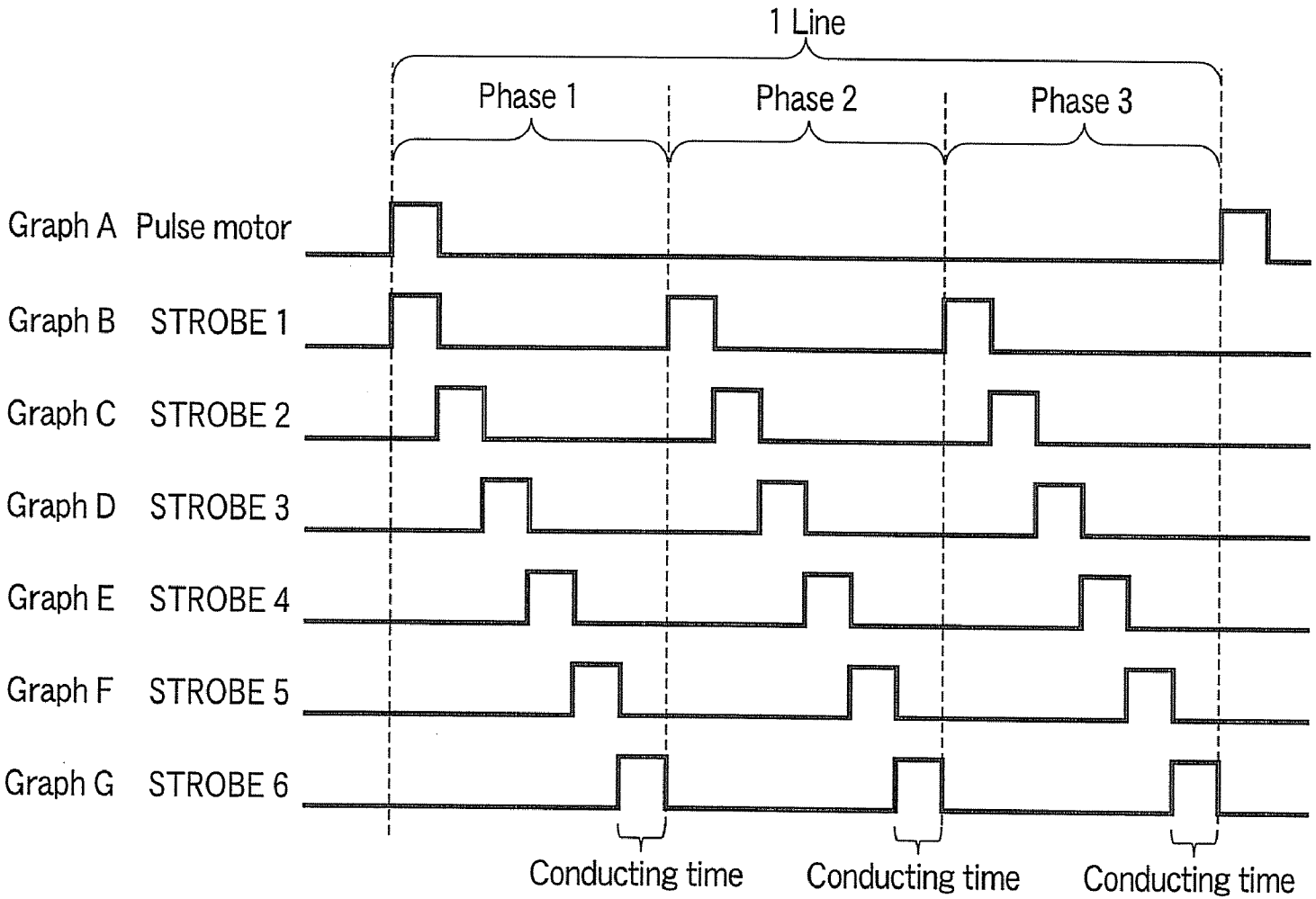
FIG. 15 is a timing chart showing the timing of the application of the strobe signals which have been subjected to conducting time dividing processing of the second embodiment.

FIG. 15 is a timing chart showing the timing of the application of the strobe signals (STROBEs 1 to 6) which have been subjected to conducting time dividing processing.

A graph A in FIG. 15 shows an example of the period of the pulse motor 4, wherein the paper 3 is carried one dot (line) in one pulse.

For example, when the thermal head 1 is divided into six strobe blocks and the conducting time of the strobe signal applied to each block is divided into three parts, the head control circuit 19 applies the strobe signals as indicated in graphs B to G in FIG. 15. That is to say, the head control circuit 19 functions as a head control unit.

That is to say, when performing processing for one phase, the conducting time control unit 193 applies one of the strobe signals (STROBEs 1 to 6) which have been divided into three parts to the corresponding strobe blocks in the order of STROBEs 1 to 6. Having finished the processing for one phase, the conducting time control unit 193 performs similar processing for the next phase. For example, when printing is performed using such strobe signals, the result is as shown in FIG. 16.

Figure 16:
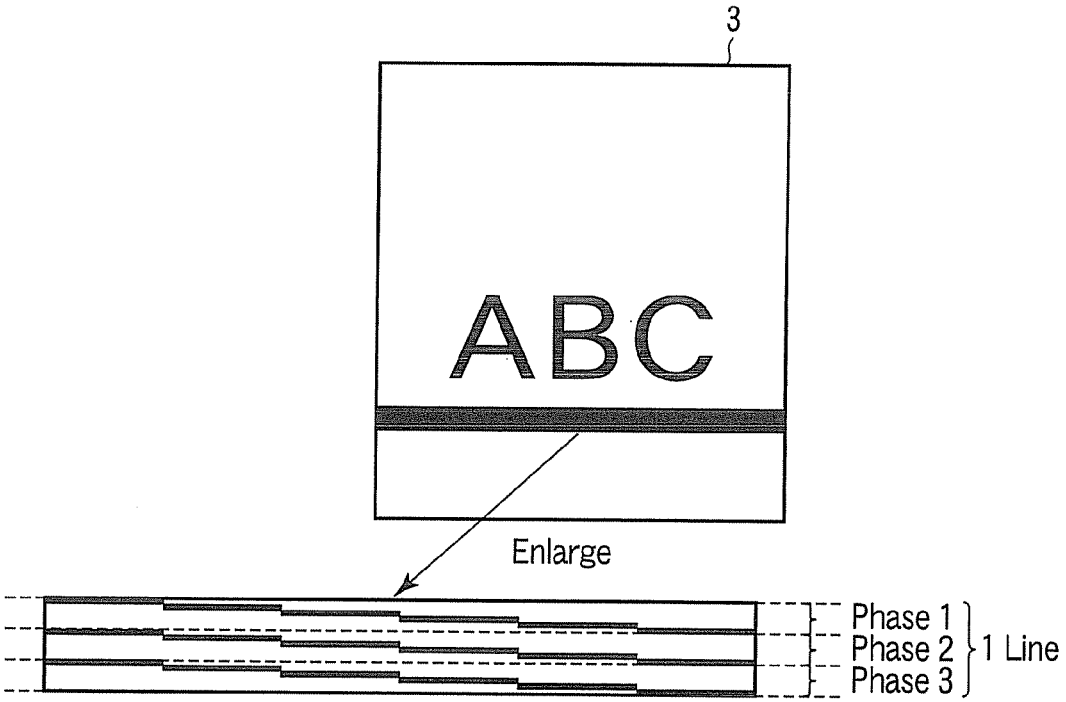
FIG. 16 is a diagram showing an example of printing in the case where the strobe signal is divided into three parts by the conducting time dividing processing of the second embodiment.

FIG. 16 is a diagram showing an example of printing in the case where the strobe signal is divided into three parts by the conducting time dividing processing. As shown in FIG. 16, in a line with a high print ratio, the strobe signals (STROBEs 1 to 6) are divided into six parts, and the conducting time in each block is divided into three parts, thereby performing printing by three phases. Thus, as compared with the misalignment caused by conventional printers, less misalignment is caused between the printing in the block to which the first strobe signal is applied and the printing in the blocks to which the subsequent strobe signals are applied. Moreover, parts where no printing is performed are dispersed and decreased, so that the printing in the vicinity of the parts where no printing is performed can cover these parts.

Having finished the printing for one line, the CPU 11 judges whether printing has been performed for all the lines of the print data (Act211). When judging that printing has been performed for all the lines of the print data (Act211, YES), the CPU 11 finishes the processing. When judging that printing has not been performed for all the lines of the print data (Act211, NO), the CPU 11 moves to Act202, and acquires print data for the next one line.

As described above, according to the second embodiment, the thermal printer 10 divides the heating elements in the thermal head 1 into a plurality of strobe blocks. The thermal printer 10 divides, into a plurality of phases, the conducting time of the strobe signal for one line in each of the divided blocks. The thermal printer 10 performs printing processing on the basis of the divided phases, and can thereby print the print data for one line. This makes it possible to reduce printing misalignment in one line. Moreover, missing printing can be prevented even when the number of divided strobe blocks is changed. As a result, it is possible to provide the thermal printer 10 and a control method of the thermal printer 10 which enable correct printing even in the case of dividing into the strobe blocks.

According to the second embodiment, the conducting time for one line is dispersed, that is to say, one conducting time can be reduced, so that sticking of the thermal head 1 to the paper 3 can also be prevented. According to the second embodiment described above, the strobe signals (STROBEs 1 to 6) are applied to the corresponding strobe blocks in one phase in the order of STROBEs 1 to 6. The second embodiment, however, is not limited thereto. The strobe signals may be applied to the strobe blocks in any order as long as the order in each phase is the same.

Furthermore, in the example mainly described in the second embodiment, the thermal head 1 is divided into six strobe blocks. The second embodiment, however, is not limited to such a configuration. The second embodiment can be applied to the thermal printer 10 regardless of the division number of the thermal head 1.

Figure 17:
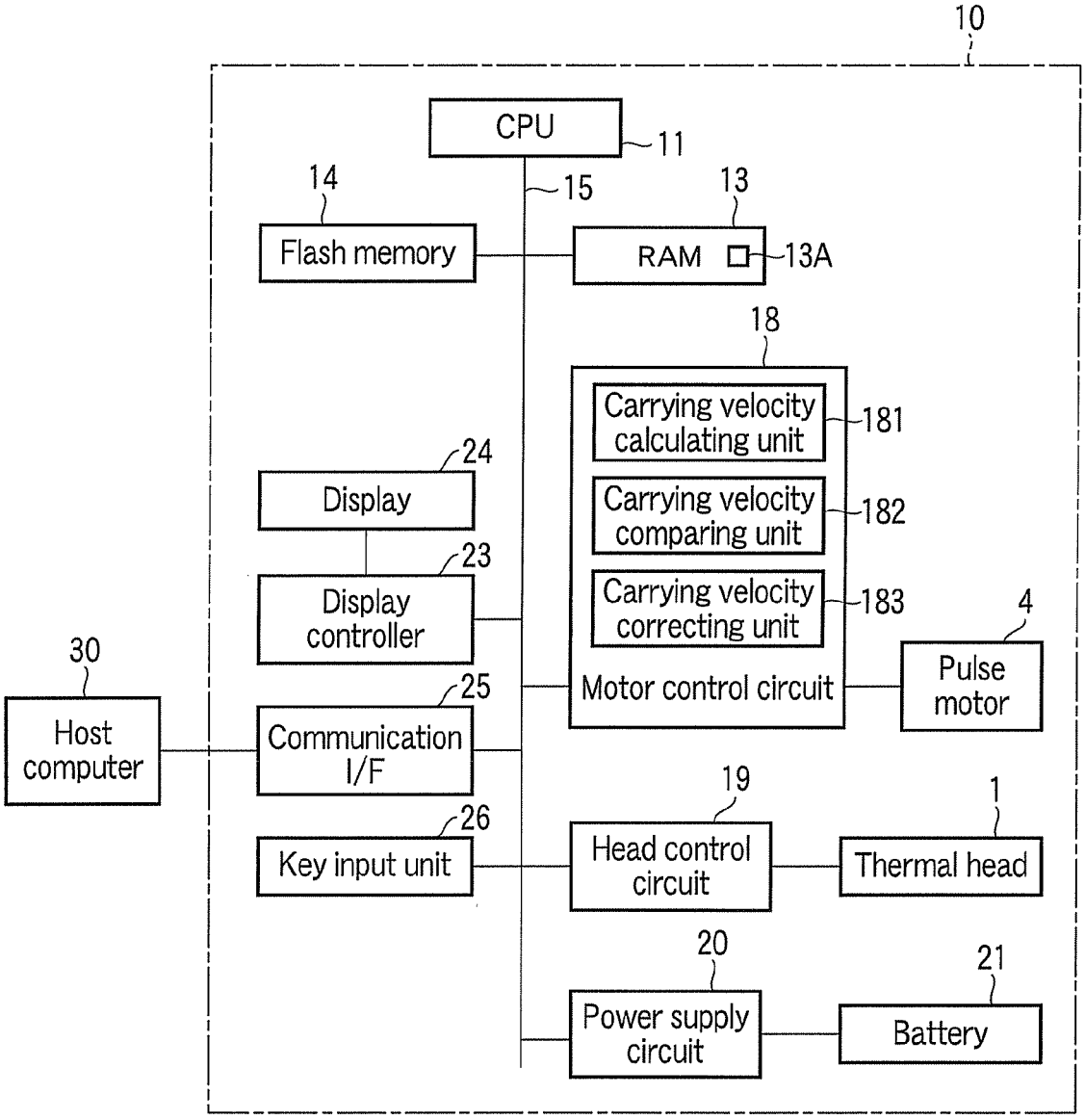
FIG. 17 is a block diagram showing the configuration of a thermal printer of a third embodiment.

Now, a third embodiment is described. FIG. 17 is a block diagram showing the configuration of a thermal printer 10 (printing apparatus) of the third embodiment. Parts with the same sings as the parts in the configuration of the thermal printer 10 of the first embodiment shown in FIG. 2 are not described. In the third embodiment, strobe signals are applied to heating elements provided in a thermal head 1 to heat the heating elements, and the heat is provided to paper 3, thereby generating color, that is to say, printing on the paper 3.

As an operation program, a flash memory 14 includes, for example, a program for executing carrying velocity correcting processing described later. A RAM 13 includes a storage area 13A for temporarily storing a carrying velocity for each step of a pulse motor 4. A head control circuit 19 applies the strobe signals to the heating elements provided in the thermal head 1, and controls printing on the paper 3. A power supply circuit 20 supplies various units with electric power accumulated in a battery 21, and thereby operates the various units.

As shown in FIG. 17, a motor control circuit 18 includes a carrying velocity calculating unit 181, a carrying velocity comparing unit 182 and a carrying velocity correcting unit 183. The motor control circuit 18 functions as a pulse motor control unit for controlling the pulse motor 4.

The carrying velocity calculating unit 181 calculates, for each step, a velocity to carry the paper 3 by the pulse motor 4, on the basis of a print ratio of print data supplied from a CPU 11. The print ratio is a ratio of the heating elements which perform printing on the paper 3 under the control of a print data signal for one line among the plurality of heating elements arranged in the thermal head 1. That is to say, the print ratio of the print data of the third embodiment is the ratio of an area which is subjected to print in a printable area of the paper 3.

Under the control of the CPU 11, the carrying velocity calculating unit 181 calculates a carrying velocity so that the time in which the pulse motor 4 operates one step corresponds to the conducting time in which the strobe signal for one line of the print data is applied to the thermal head 1. The carrying velocity calculating unit 181 temporarily saves the calculated carrying velocity for each step in the storage area 13A of the RAM 13. For example, the carrying velocity is as follows when print data as shown in FIG. 18 is printed.

Figure 18:
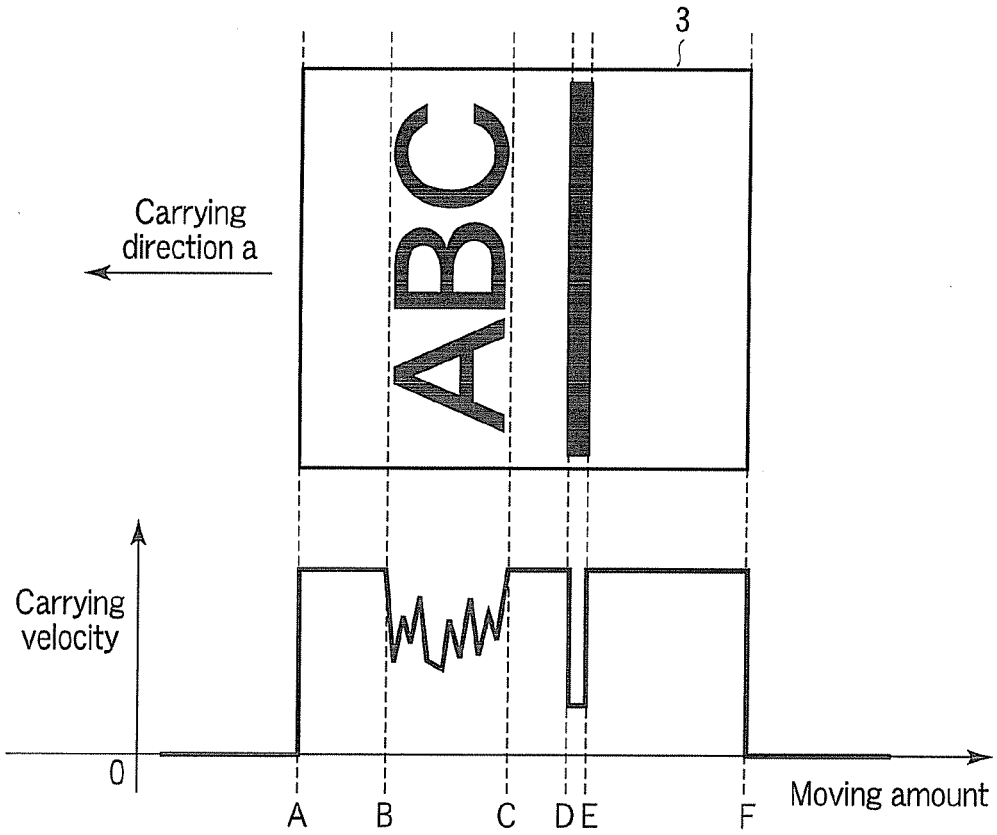
FIG. 18 is a graph explaining the relation between print data and carrying velocity of the third embodiment.

FIG. 18 is a graph for explaining the relation between the print data and the carrying velocity. As shown in FIG. 18, printing is performed on the paper 3 which is carried in a carrying direction a. The horizontal axis of the graph indicates the moving amount of the paper 3, and the vertical axis indicates the carrying velocity.

That is to say, when the paper 3 is carried from a position A to a position B shown in FIG. 18, no printing is performed, so that the carrying velocity in the corresponding step is high. When the paper 3 is carried from the position B to a position C shown in FIG. 18, characters are printed, so that a carrying velocity in the corresponding step is calculated in accordance with the print ratio for each line of the print data.

When the paper 3 is carried from the position C to a position D shown in FIG. 18, no printing is performed, so that the carrying velocity in the corresponding step is again at the maximum. When the paper 3 is carried from the position D to a position E shown in FIG. 18, printing with a high print ratio is performed, so that the carrying velocity in the corresponding step is low. When the paper 3 is carried from the position E to a position F shown in FIG. 18, no printing is performed, so that the carrying velocity in the corresponding step is high.

As described above, the carrying velocity calculating unit 181 calculates a carrying velocity for each step. However, a platen roller 2 has a moment of inertia as described above. Thus, there is a limit value in the carrying velocity that can be changed in one step, that is to say, there is a limit value in acceleration and deceleration. For example, when the thermal head 1 has a resolution of 203 dpi, 16 steps are necessary to move from a stopped state to a state at the maximum velocity or from a state at the maximum velocity to a stopped state.

For example, when it is necessary to decelerate beyond the limit value of deceleration, the paper 3 is carried at a velocity higher than a target carrying velocity because it is not possible to decelerate to the velocity (target velocity) calculated from the print ratio. This may disadvantageously prevent correct printing. It is therefore necessary to correct the carrying velocities in the several previous steps so that the velocity can be reduced to the target carrying velocity.

The carrying velocity comparing unit 182 makes comparison of the carrying velocities among the steps, and judges whether to accelerate and decelerate through the steps.

Under the control of the CPU 11, the carrying velocity correcting unit 183 performs carrying velocity correcting processing to correct the carrying velocity in each step referring to the carrying velocity in each step stored in the storage area 13A of the RAM 13. That is to say, when the carrying velocity comparing unit 182 judges to decelerate, the carrying velocity correcting unit 183 decides how many steps are necessary for deceleration to the target carrying velocity, and corrects the carrying velocity in each step calculated by the carrying velocity calculating unit 181 to decelerate through the decided steps.

When the carrying velocity comparing unit 182 judges to accelerate, the carrying velocity correcting unit 183 judges whether the target carrying velocity can be reached. When judging that the target carrying velocity can't be reached, the carrying velocity correcting unit 183 corrects the carrying velocity to accelerate in accordance with the limit value of acceleration.

Figure 19:
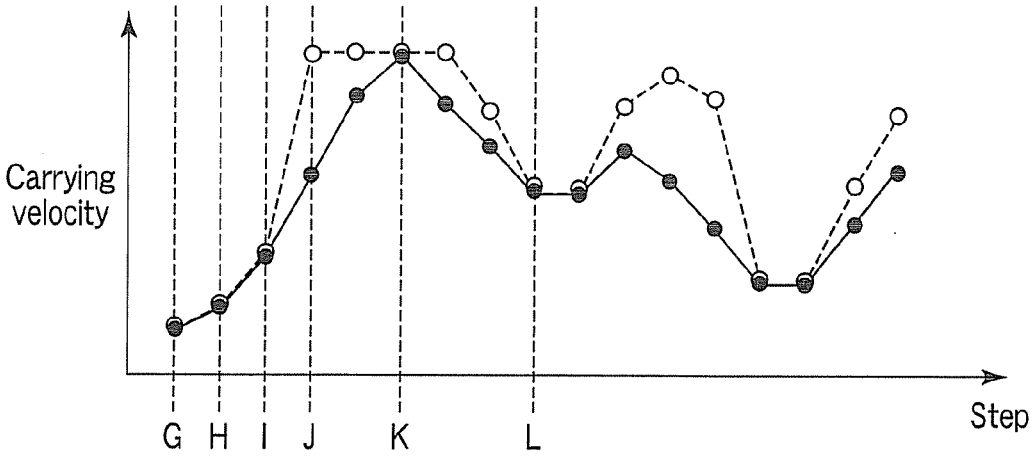
FIG. 19 is a graph explaining carrying velocity correcting processing of the third embodiment.

FIG. 19 is a graph for explaining the carrying velocity correcting processing. The horizontal axis of the graph indicates the number of steps of the pulse motor 4, and the vertical axis indicates the carrying velocity.

A broken line in the graph connects carrying velocities (target velocities) in the respective steps calculated by the carrying velocity calculating unit 181. A full line in the graph connects carrying velocities (corrected velocities) in the respective steps corrected by the carrying velocity correcting unit 183.

For example, the carrying velocity comparing unit 182 compares the target velocity in the step G in FIG. 19 with the target velocity in the next step, that is to say, in the step H. The carrying velocity comparing unit 182 judges to accelerate when the velocity in the step H is higher, or judges to decelerate when the velocity in the step H is lower. Here, as the velocity in the step H is higher, the carrying velocity comparing unit 182 judges to accelerate.

When the carrying velocity comparing unit 182 judges to accelerate, the carrying velocity correcting unit 183 judges whether the velocity can be accelerated in one step from the target velocity in the step G to the target velocity in the step H. That is to say, the carrying velocity correcting unit 183 judges whether the difference of velocity between the step G and the step H is less than the limit value of acceleration. Here, as the difference of velocity between the step G and the step H is less than the limit value of acceleration, the carrying velocity correcting unit 183 does not correct the carrying velocity in the step H. In addition, the carrying velocity is not corrected either between the step H and the step I.

When the target velocity in the step I in FIG. 19 is compared with the target velocity in the step J, the velocity in the step J is higher, so that the carrying velocity comparing unit 182 judges to accelerate. Further, the carrying velocity correcting unit 183 judges whether the velocity can be accelerated in one step from the step I to the step J.

Here, as the difference of velocity between the step I and the step J is equal to or more than the limit value of acceleration, the carrying velocity correcting unit 183 corrects the carrying velocity so that the carrying velocity in the step J may be the velocity accelerated from the velocity in the step I in accordance with the limit value of acceleration. That is to say, as shown in FIG. 19, the actual velocity in the step J is the corrected velocity.

When the target velocity in the step L in FIG. 19 is compared with the target velocity in the previous step, the velocity in the step L is lower, so that the carrying velocity comparing unit 182 judges to decelerate. Further, the carrying velocity correcting unit 183 judges whether the velocity can be decelerated in one step from the velocity in the previous step to the velocity in the step L. That is to say, the carrying velocity correcting unit 183 judges whether the difference of velocity between the step L and the previous step is less than the limit value of deceleration.

Here, as the difference of velocity between the step L and the previous step is equal to or more than the limit value of deceleration, the carrying velocity correcting unit 183 corrects the carrying velocity in the step L. That is to say, the carrying velocity correcting unit 183 judges how many previous steps permit deceleration to the target velocity in the step L. That is to say, the carrying velocity correcting unit 183 judges whether the target velocity in the step L is reached when the velocity is reduced in each of the steps before the step L by the limit value of deceleration, and thereby judges how many previous steps permit deceleration to the target velocity in the step L.

According to the example shown in FIG. 19, the velocity can be decelerated from the point three steps before the step L, that is to say, from the step K. Thus, the carrying velocity correcting unit 183 corrects the carrying velocity so that deceleration is started from the step K to reach the carrying velocity in the step L. That is to say, the carrying velocity correcting unit 183 corrects the carrying velocity by rewriting the carrying velocity in each of the steps K to L stored in the storage area 13A of the RAM 13.

The carrying velocity correcting processing described above makes it possible to correct the carrying velocity as indicated by the full line on the basis of the broken line which connects the target velocities in the graph.

Figure 20:
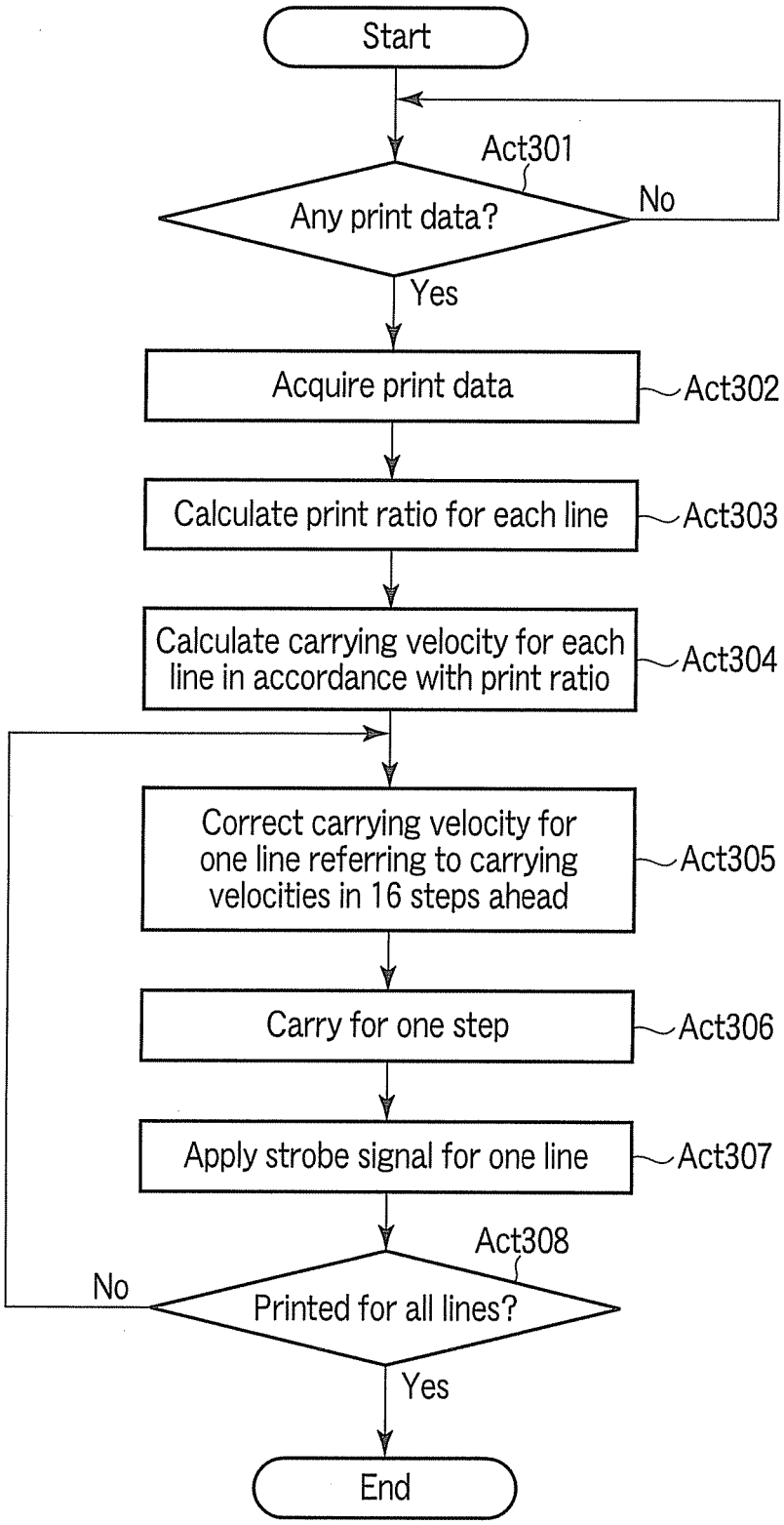
FIG. 20 is a flowchart explaining processing in the case of printing by the thermal printer of the third embodiment.

FIG. 20 is a flowchart for explaining processing in the case of printing by the thermal printer 10 shown in FIG. 17. Here, it is described on the assumption that a thermal head having a resolution of 203 dpi is attached as the thermal head 1.

When the thermal printer 10 is powered on, a system is started. That is to say, the CPU 11 reads various programs from the flash memory 14, and expands the programs in the RAM 13. When the system is started, the CPU 11 checks the system. That is to say, the CPU 11 examines the state of each unit in the thermal printer 10.

When started, the CPU 11 of the thermal printer 10 is ready to receive print data (Act301). On receipt of print data (Act301, YES), the CPU 11 acquires print data for each line (Act302). The CPU 11 calculates a print ratio of the print data for each line (Act303). That is to say, from information on the number of dark parts contained in the print data for one line, the CPU 11 calculates the ratio of the heating elements to which the strobe signals need to be applied among all of the heating elements provided in the thermal head 1.

On the basis of the calculated print ratio, the carrying velocity calculating unit 181 of the motor control circuit 18 shown in FIG. 17 calculates a carrying velocity for each line (step) under the control of the CPU 11 (Act304). That is to say, the carrying velocity calculating unit 181 calculates the timing for the operation of the pulse motor 4 for each step. The carrying velocity calculating unit 181 stores the calculated carrying velocity for each step in the storage area 13A of the RAM 13.

Referring to the RAM 13, the carrying velocity comparing unit 182 and the carrying velocity correcting unit 183 of the motor control circuit 18 perform the carrying velocity correcting processing on the basis of the target carrying velocities in the 16 steps ahead out of the carrying velocities in the respective steps calculated by the carrying velocity calculating unit 181, thereby correcting the carrying velocity for one step (Act305).

The motor control circuit 18 controls the pulse motor 4 so that the paper 3 is carried in accordance with the carrying velocity for one step corrected by the carrying velocity correcting unit 183 (Act306). The head control circuit 19 applies a strobe signal for one line to the thermal head 1 under the control of the CPU 11 (Act307).

Having finished the printing for one line, the CPU 11 judges whether printing has been performed for all the lines of the print data (Act308). When judging that printing has been performed for all the lines of the print data (Act308, YES), the CPU 11 finishes the processing. When judging that printing has not been performed for all the lines of the print data (Act308, NO), the CPU 11 moves to Act305, and corrects the carrying velocity in the next step, and thus performs printing.

Figure 21:
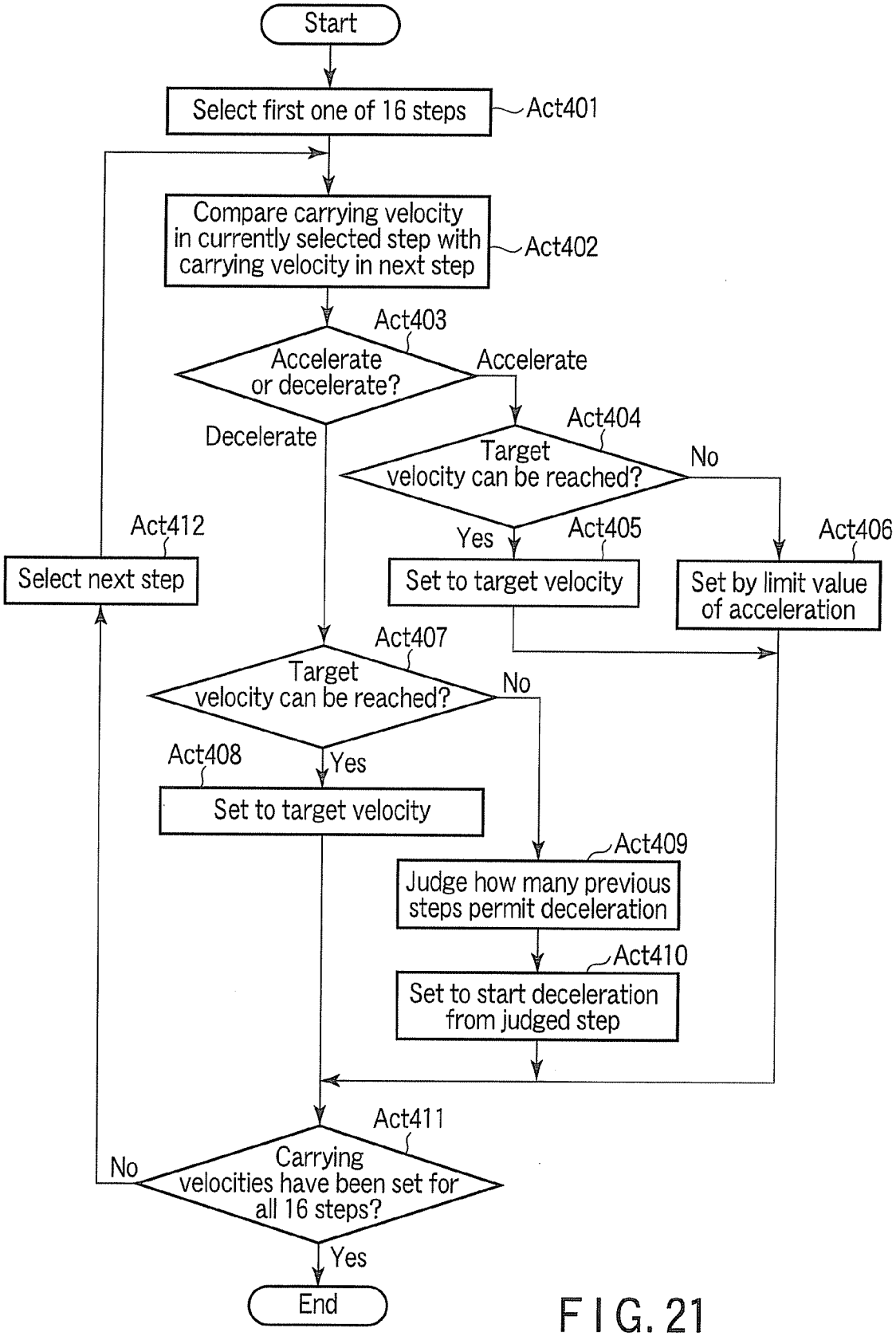
FIG. 21 is a flowchart explaining the carrying velocity correcting processing performed by the thermal printer of the third embodiment.

FIG. 21 is a flowchart for explaining processing in the case where the carrying velocity correcting processing is performed by the thermal printer 10 shown in FIG. 17.

The CPU 11 selects the first one of the 16 steps which have been referred to (Act401). Under the control of the CPU 11, the carrying velocity comparing unit 182 compares the carrying velocity in the selected step with the carrying velocity in the next step (Act402).

In accordance with the comparison, the carrying velocity comparing unit 182 judges whether to accelerate or decelerate between the compared two steps (Act403). That is to say, the carrying velocity comparing unit 182 judges to accelerate when the carrying velocity in the selected step is higher than the carrying velocity in the next step, while the carrying velocity comparing unit 182 judges to decelerate when the carrying velocity in the selected step is lower than the carrying velocity in the next step.

When judging to accelerate in Act403, the carrying velocity correcting unit 183 judges whether the target velocity can be reached (Act404). That is to say, the carrying velocity correcting unit 183 judges whether the velocity can be accelerated by the limit value of acceleration from the carrying velocity in the currently selected step to the carrying velocity (target velocity) in the next step calculated by the carrying velocity calculating unit 181.

When judging that the target velocity can be reached (Act404, YES), the carrying velocity correcting unit 183 sets the carrying velocity in the next step to the target velocity (Act405). That is to say, the carrying velocity correcting unit 183 does not correct the carrying velocity.

When judging that the target velocity can not be reached (Act404, NO), the carrying velocity correcting unit 183 sets the carrying velocity in the next step to a velocity in which the limit value of acceleration is added to the carrying velocity in the step being selected (Act406).

When judging to decelerate in Act403, the carrying velocity correcting unit 183 judges whether the target velocity can be reached (Act407). That is to say, the carrying velocity correcting unit 183 judges whether the velocity can be decelerated by the limit value of deceleration from the carrying velocity in the currently selected step to the carrying velocity (target velocity) in the next step calculated by the carrying velocity calculating unit 181.

When judging that the target velocity can be reached (Act407, YES), the carrying velocity correcting unit 183 sets the carrying velocity in the next step to the target velocity (Act408). That is to say, the carrying velocity correcting unit 183 does not correct the carrying velocity.

When judging that the target velocity can not be reached (Act407, NO), the carrying velocity correcting unit 183 judges how many previous steps permit deceleration to the target velocity (Act409). The carrying velocity correcting unit 183 corrects the carrying velocity in each step so that the target velocity may be reached from the step in which the velocity can be decelerated (Act410).

Having set the carrying velocity for one step, the CPU 11 judges whether carrying velocities have been set for all of the 16 steps (Act411). When there are remaining steps for which carrying velocities have not been set (Act411, NO), the CPU 11 selects a step subsequent to the currently selected step, that is to say, a step for which a carrying velocity has been set (Act412), and moves to Act402.

When judging that carrying velocities have been set for all of the steps (Act411, YES), the CPU 11 determines the carrying velocity in the first one of the 16 steps, and performs processing shown in Act306 and Act307 shown in FIG. 20.

As described above, according to the third embodiment, when there is a step whose target velocity can not be reached by deceleration between two steps, the carrying velocities in some steps are corrected so that deceleration is started from the step that permits the deceleration to the target velocity. That is to say, the carrying velocities in the several subsequent steps are referred to every line of the print data, and a carrying velocity is determined every line.

According to the configuration described above, the thermal printer 10 can correctly carry the paper 3 without decreasing the overall processing velocity. As a result, it is possible to provide a printing apparatus and a printing apparatus control method capable of correctly performing printing at high velocity.

Although the thermal head 1 having a resolution of 203 dpi is attached in the example described in the third embodiment, the third embodiment is not limited thereto. The third embodiment can be applied to the thermal printer 10 regardless of the resolution of the thermal head 1 used.

Moreover, according to the third embodiment, when a thermal head 1 having a resolution of 203 dpi is used, the number of steps referred to by the carrying velocity correcting processing is 16 because 16 steps are necessary to reach the maximum velocity from the minimum velocity. The third embodiment, however, is not limited thereto. The number of steps referred to by the carrying velocity correcting processing can be suitably changed in accordance with the specifications of the thermal head 1 and the platen roller 2 adapted to the thermal head 1. That is to say, the number of steps necessary to reach the maximum velocity from the minimum velocity has only to be referred to.

Moreover, the carrying velocities for all the lines of the print data may be corrected in advance. That is to say, without determining the carrying velocity step by step, the above-described carrying velocity correcting processing may be performed for all the steps, and the carrying velocities for all the steps may be determined at the same time.

What is claimed is:

1. A printing apparatus comprising:

a thermal head in which a plurality of heating elements are provided in a width direction of paper;

an analyzing unit which analyzes whether an input print layout contains any bar code;

a calculating unit which calculates a print ratio of a bar code portion in the paper for each line of the print layout in the case where the analyzing unit analyzes that at least the print layout contains a bar code;

a setting unit which sets a printing velocity corresponding to the print ratio for one line in the bar code portion calculated by the calculating unit in the case where the analyzing unit analyzes that the print layout contains the bar code; and a changing unit which changes a velocity at which the thermal head performs printing on the paper for one line to the printing velocity set by the setting unit.

2. A printing velocity determining method applied to a printing apparatus including a thermal head in which a plurality of heating elements are provided in a width direction of paper, the method comprising:

analyzing whether an input print layout contains any bar code;

calculating a print ratio of a bar code portion in the paper for each line of the print layout in the case where the analysis proves that at least the print layout contains a bar code;

setting a printing velocity corresponding to the calculated print ratio for one line in the bar code portion in the case where the analysis proves that the print layout contains the bar code; and changing a velocity at which the thermal head performs printing on the paper for one line to the set printing velocity.

3. A printing velocity determining program applied to a computer which controls a printing apparatus, the printing apparatus including a thermal head in which a plurality of heating elements are provided in a width direction of paper, the program comprising:

a function to analyze whether an input print layout contains any bar code;

a function to calculate a print ratio of a bar code portion in the paper for each line of the print layout in the case where the analysis proves that at least the print layout contains a bar code;

a function to set a printing velocity corresponding to the calculated print ratio for one line in the bar code portion in the case where the analysis proves that the print layout contains the bar code; and a function to change a velocity at which the thermal head performs printing on the paper for one line to the set printing velocity.

* * * * *